United States Patent [19]

Dankert

[11] 4,178,733

[45] Dec. 18, 1979

[54] TORQUE OPEN CAPPING CHUCK IMPROVEMENT

[75] Inventor: Harry S. Dankert, Texas Township, Kalamazoo County, Mich.

[73] Assignee: The Upjohn Company, Kalamazoo, Mich.

[21] Appl. No.: 874,749

[22] Filed: Feb. 3, 1978

[51] Int. Cl.[2] ..... B67B 3/20; B65B 7/28

[52] U.S. Cl. ..... 53/331.5

[58] Field of Search ..... 53/331.5, 317; 279/1 J, 279/107, 108

[56] References Cited

U.S. PATENT DOCUMENTS

| | | | |
|---|---|---|---|
| 2,076,631 | 4/1937 | Gantzer | 53/317 |
| 2,819,577 | 1/1958 | Dimond | 53/317 |
| 3,031,822 | 5/1962 | Dimond | 53/331.5 X |
| 3,537,231 | 11/1970 | Dimond | 53/317 X |
| 4,089,153 | 5/1978 | Long | 53/331.5 |

*Primary Examiner*—Horace M. Culver

*Attorney, Agent, or Firm*—Blanchard, Flynn, Thiel, Boutell & Tanis

[57] ABSTRACT

Chuck for a bottle capper. In previously known chucks for bottle cappers, especially those made in accordance with U.S. Pat. No. 3,537,231 and its immediate predecessors, there has been a tendency during operation for the chuck jaws to twist or cock which is damaging to the bottle caps. The present invention provides a ball inserted between a portion of the chuck jaw and the walls surrounding and encasing same, which ball positively resists such twisting or cocking without interfering with the desired opening and closing of the jaws. Further means are also provided for improving the smoothness of operation of the apparatus, namely a roller over the drive pin by which rotation of the jaws is effected.

5 Claims, 5 Drawing Figures

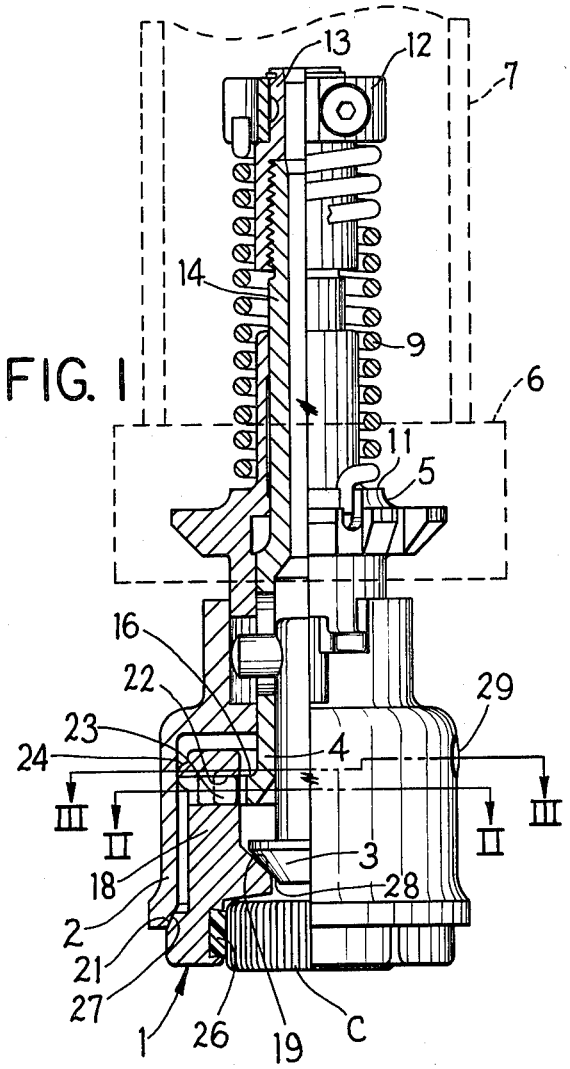
FIG. 1
FIG. 2
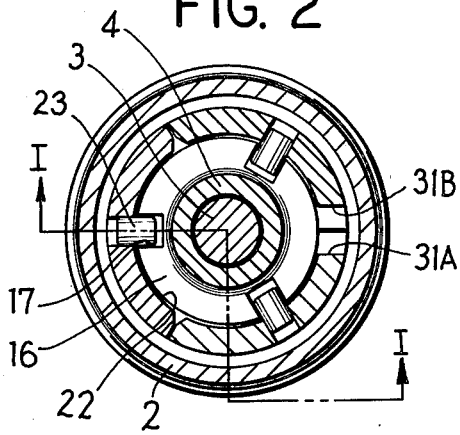
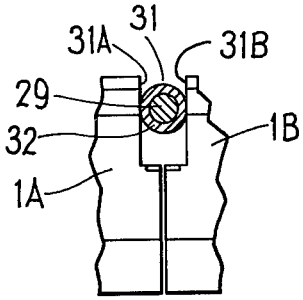
FIG. 4
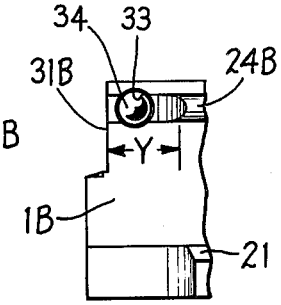
FIG. 5
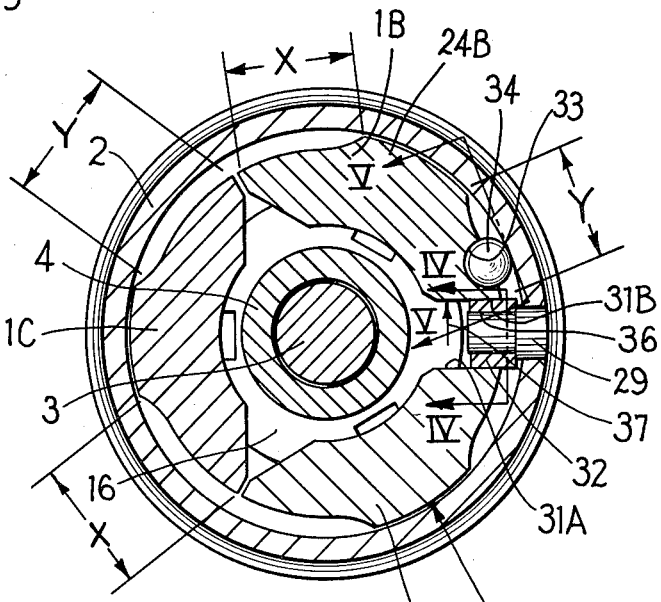
FIG. 3

TORQUE OPEN CAPPING CHUCK IMPROVEMENT

FIELD OF THE INVENTION

The invention relates to a chuck for a bottle capper and particularly to a generally collet-type chuck in which the jaws are positively held against tilting or cocking during the rotating driving thereof.

BACKGROUND OF THE INVENTION

Generally collet-type chucks for use in bottle cappers have been known for many years and a wide range of specific designs for same have been suggested. Over the years, the unique requirements of such bottle cappers as compared to collet chucks used in such machine tools as lathes have become recognized and a distinct line of designs has been developed to meet these requirements.

Among these requirements have been the extremely high speed at which bottle capper chucks are caused to open and close and hence both the opening and closing thereof must be under a positive control. Further, the chuck jaws must be relatively loose in the surrounding casing, both to minimize frictional resistance to the desired high-speed operation and in recognition of the fact that the high-speed operation will result in rather substantial wear on the parts so that the precise dimensioning thereof cannot be permitted too high a level of criticality. These requirements have been well met by the chuck shown in the above-mentioned patent to Dimond, U.S. Pat. No. 3,537,321 and in the lineal predecessors of said patent, such as the patent to Dimond, U.S. Pat. No. 3,242,632. However, in this otherwise highly successful prior known device the necessary looseness of the jaws permits a certain amount of twisting or cocking of same when they are subjected to a driving force during otherwise normal operation. Where the cap to be screwed on is of relatively heavy material, this is no great disadvantage but when such cap is of a softer or more easily damaged material, such as a thin metal, then such cocking by the chuck jaws can produce a finished product which is unsightly at best and in many cases highly undesirable due to uneven tightening of the cap onto the bottle.

Particularly in the device of the above-mentioned patents, the jaws are driven from the surrounding casing or bell through a single pin which bears against one of said jaws. As said jaws are moved into and out from bottle cap gripping position a large number of times per minute, and the rotation of the chuck is started and stopped an equally large number of times per minute, the rotary and axial loads occurring between said pin and the driven one of said jaws are such as to cause a substantial twisting of said jaw with respect to said bell. The jaws are sufficiently aligned with each other that when the driven one thereof twists, the others will follow. This effects an irregular gripping of the bottle cap and also exerts a sufficiently concentrated pressure between a portion of each respective jaw, particularly the driven jaw and the surrounding casing or bell, as to rub off the lubrication applied thereto. This effects a very rapid wear of such jaw which in turn requires frequent readjustment of the chuck. Such readjustment requires downtime and inasmuch as this has in the past occurred every few hours, it means that the machine will have a certain amount of downtime at relatively short intervals.

Accordingly, the objects of the invention include:

1. To improve previously known chucks for bottle capping machines, particularly of the type illustrated in U.S. Pat. No. 3,537,231, to facilitate the smooth and accurate operation thereof.

2. To provide an improvement in chucks for a bottle capping machine, as aforesaid, in which the chuck elements are positively prevented from cocking or twisting in response to a rotating drive thereof.

3. To provide an improvement, as aforesaid, which will require a minimum of physical modification to the original equipment.

4. To provide a modification, as aforesaid, which can be carried out at a minimum of expense but which will ensure that the chuck jaws when gripped in driving condition will come much closer to defining a perfect circle than did the jaws of the above-mentioned previously known equipment.

5. To provide a device, as aforesaid, which will be operable in the same manner as the previously known equipment and which will be fully compatible therewith.

6. To provide a device, as aforesaid, which will be operable without downtime over much longer periods than has been obtainable from the apparatus known thus far.

Other objects and purposes of the invention will be apparent to persons acquainted with apparatus of this general type upon reading the following specification and inspection of the accompanying drawings.

BRIEF DESCRIPTION OF THE DRAWINGS

In the drawings:

FIG. 1 is a central sectional view through a chuck jaw mechanism embodying the invention, the plane of said sectional view being that indicated in FIG. 2.

FIG. 2 is a section taken on the line II—II of FIG. 1.

FIG. 3 is a sectional view taken on the line III—III of FIG. 1.

FIG. 4 is a fragmentary sectional view taken on line IV—IV of FIG. 3.

FIG. 5 is a fragmentary sectional view taken on the line V—V of FIG. 3.

DETAILED DESCRIPTION

While the general construction and operation of a chuck of this type is well known and is fully set forth in the above-mentioned patents, same for convenience will be briefly reviewed here to insure a better understanding of the current invention.

The principal components of the chuck with which the invention is concerned are the chuck jaws 1, the chuck bell 2, the chuck actuator 3 and the sleeve 4. The jaws are held in the bell by the sleeve 4 which is associated through a drivingly connected drive gear 5 with a torque opening mechanism 6 of known type, here shown only schematically but illustrated and described fully in the prior art, particularly the above-mentioned patents. An adapter sleeve 7 connects the chuck mechanism to drive means already fully known and particularly further described in the above-mentioned patent and transmits the rotary motion of such drive means in a known manner to the chuck mechanism through the torque opening mechanism 6.

In the parts of more concern to the present invention, there is provided a spring 9 seated on the hub 11 of the drive gear 5, which latter is supported by means already known to the art, and the other end of said spring bears against a collar 12. Said collar is connected by means of an intermediate sleeve 13 to the upper extension 14 of the sleeve 4. The lower end of the sleeve 4 has an outwardly flaring flange 16 (FIGS. 1 and 2) having cut in from its periphery notches 17.

The chuck jaws each have a body portion 18 with an inwardly facing cam 19 for purposes appearing hereinafter, an outwardly facing cam 21 and an inwardly facing groove 22. Each of said grooves 22 has a pin 23 extending thereinto from the outward surface of the chuck jaw. On the outer surface of the chuck jaw and spaced shortly above said groove, is a fulcrum ridge 24 having a rounded outward surface and being of relatively limited circumferential extent.

The bottle engaging surface of the chuck jaw is preferably lined by a plastic contact strip 26 to minimize abrasion against the bottle cap to be handled. A pin 29 is mounted in the bell 2, extends inwardly of its inner surface and is received into a notch 31 provided by suitable cutouts 31A and 31B in two adjacent chuck jaws, here the jaws 1A and 1B.

The flange 16 above mentioned extends into each of the grooves 22 and the notches 17 each receive one of the pins 23. Thus, the upward urging of the spring 9 bearing against the collar 12 is transmitted via the intermediate sleeve 13 to the sleeve 4 and acts through the flange 16 against the upper side of the groove 22 to move the chuck jaw upwardly. This causes the cam surface 21 to react against a cam surface 27 on the bell 2, which latter is likewise held fixed in a known manner not here shown, to cause inward movement of the lower end of the chuck jaws and gripping of the cap C. It will be noted particularly that in such actuation of the chuck jaws, same are caused to pivot on the fulcrum ridge 24 against the inner surface of the bell 2.

Opening of the jaws 1 is positively effected in what is likewise a known manner by the chuck actuator, or stripper, 3. It is driven downwardly by control means, not shown but which are fully known to the prior art and particularly described in the above-mentioned patents, and same is caused to act through its cam surface 28 against the cam surface 19 of the chuck jaw to effect a positive opening thereof.

All of the foregoing is known to the prior art, forms by itself no part of the present invention and is described herein merely to facilitate a complete understanding of the invention.

Turning now to the modifications in the above apparatus by which the present invention is expressed, attention is first directed to the bell pin 29 (FIG. 4). There is provided on this pin a roller 32 fitting snugly but slidably within the notch 31, formed in adjacent portions of two jaws, when the jaws are in their bottle cap gripping positions. Obviously, when said jaws are relaxed into bottle cap releasing position, the roller will then be somewhat loose within said notch. This roller eases the movement of the jaw elements in their axial direction and facilitates the movement of the jaws into, and/or out of, bottle cap gripping position even though same are under driving load.

Now turning to FIG. 5, there is shown a portion of the jaw 1B from a slightly different radial position than that of FIG. 4. It will be here, and in FIG. 3, noted that the fulcrum ridge 24B does not extend the full circumferential distance of the jaw 1B but instead (see FIG. 3) terminates at distances approximately $\frac{1}{3}$ of the circumferential extent of said jaw from each vertical edge thereof. In other words, with each jaw being of approximately 120° in circumferential extent (less only the operating clearance between adjacent edges of the respective jaws), the distances X and Y appearing in FIG. 3 will each be approximately 40° in extent. In the space Y namely the end of the fulcrum 24B adjacent the surface 31B of notch 31, there is positioned a recess 33 into which is positioned a ball 34. Said recess is located on the same circumferential line as the center of the fulcrum ridge 24B and the ball 34 when in position within the recess 33 extends radially outwardly a distance slightly greater than the corresponding extent of the fulcrum ridge 24B.

It will be understood that the fulcrum ridges on the remaining jaws 1A and 1C (FIG. 3) are similar to the fulcrum ridge 24B. It should be noted that the recess 33 and ball 34 are placed on that jaw, here the jaw 1B, which receives an accelerating rotary drive from the bell 2 by way of the pin 29 and roller 32. Since the tangent to any outer surface of the jaw 1B is at an acute angle to the force receiving surface 31B, there is in effect a radially outwardly directed force component applied to the upper end of the drive receiving jaw 1B by the pin 29 and roller or sleeve 32. In other words, the torque thrust which effects rotation of the jaws 1 is applied to the end surface 31B of the jaw 1B by the roller 32 in the direction indicated by the arrow 37. Such radially outwardly directed component of the driving force acts largely in the "Y" zone of the jaw 1B and is opposed by the bearing of the ball 34 against the inner surface of the bell 2. Thus, the previous tendency for the jaw 1B to twist or cock is eliminated by the ball 34.

The other two jaws 1A and 1C float more freely within the bell 2 and will follow the alignment of the driven jaw 1B. Accordingly it is unnecessary to provide them with a recess and ball corresponding to the recess 33 and ball 34.

With this arrangement as described, it has been found by actual test that the previously experienced excessive wear on the fulcrum ridge 24B is eliminated without creating any adverse effects in the operation of the chuck. Similarly, it has been found that the previous tendency of parts of the chuck jaws to wear off the lubrication provided for same is appreciably lessened. Thus, a single setting of such jaws, by the collar 12 acting on spring 9, will be effective for several days of operation whereas previously it was often necessary to readjust such chucks after only a few hours of operation. This greatly diminishes the downtime of any given machine with the resulting obvious operating advantages.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a chuck for a bottle capping machine, said chuck comprising:

an annular outer casing and torque means for accelerating and decelerating rotation thereof, a plurality of collet-type chuck jaws arranged within said outer casing and cooperable therewith for opening and closing in response to axial movement of said casing relative to said jaws, pin means extending from said casing and received between two of said jaws for transmitting thereto the rotation applied to said casing by said torque means, and means responsive to a predetermined resistance of said jaws to said rotation thereof by said casing for effecting axial movement of said casing, thereby causing opening of said jaws, the improvement comprising:

a bearing ball positioned rotatably on an outer face of that one of said jaws which receives an accelerating circumferential thrust from said pin means, said ball being near said pin means and bearing against the opposed surface of said casing for limiting the movement of that portion of said one jaw adjacent said ball toward said casing in response to an application of said circumferential thrust by said pin means to said one jaw.

2. The device of claim 1 wherein each of said jaws is engageable at one end thereof with a bottle cap and includes a fulcrum ridge extending radially therefrom near the end thereof remote from said one end thereof, the further improvement comprising the positioning of said bearing ball on a circumferential line through the center of that portion of said fulcrum ridge which contacts the opposed surface of the casing, said bearing ball extending radially toward said casing a distance substantially the same as the corresponding extent of said fulcrum ridge, whereby the tendency of the edge of said one jaw adjacent said pin means to move toward said casing in response to circumferential thrust from said pin means will be substantially fully opposed by said bearing ball.

3. The device of claim 1 wherein there is provided a recess in the outer surface of said one chuck jaw and said bearing ball is received within said recess for rotation therein to facilitate the movement of said one chuck jaw axially of said casing for effecting opening and closing of said chuck.

4. The device of claim 1 wherein a roller is provided surrounding said pin to facilitate the axial movement of said chuck jaws with respect to said casing during either an acceleration or deceleration of the rotation of said chuck.

5. The device of claim 3, wherein said bearing ball acts as a bearing surface upon, and relative to, which said casing moves axially and circumferentially.

* * * * *